US011506200B1

(12) United States Patent
Zhang et al.

(10) Patent No.: US 11,506,200 B1
(45) Date of Patent: Nov. 22, 2022

(54) HYDRAULIC GEAR PUMP WITH RADIAL PRESSURE COMPENSATOR

(71) Applicant: Parker-Hannifin Corporation, Cleveland, OH (US)

(72) Inventors: Hao Zhang, Twinsburg, OH (US); Satish Kumar Raju Kalidindi, Mayfield Heights, OH (US); Yu-Sen Chu, Westlake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 188 days.

(21) Appl. No.: 16/951,480

(22) Filed: Nov. 18, 2020

Related U.S. Application Data

(60) Provisional application No. 62/982,310, filed on Feb. 27, 2020.

(51) Int. Cl.

| | |
|---|---|
| ***F04C 14/24*** | (2006.01) |
| ***F04C 15/00*** | (2006.01) |
| ***F04C 2/10*** | (2006.01) |

(52) U.S. Cl.
CPC ..... *F04C 14/24* (2013.01); *F04C 2/101* (2013.01); *F04C 15/0026* (2013.01); *F04C 2240/80* (2013.01)

(58) Field of Classification Search
CPC ..... F04C 14/24; F04C 2/101; F04C 15/0026; F04C 2240/80
See application file for complete search history.

(56) References Cited

U.S. PATENT DOCUMENTS

| | | | |
|---|---|---|---|
| 5,951,274 | A | 9/1999 | Bellemann et al. |
| 6,183,229 | B1 | 2/2001 | Friedmann |
| 9,945,377 | B2 | 4/2018 | Pippes et al. |
| 10,060,432 | B2 | 8/2018 | Pippes et al. |

FOREIGN PATENT DOCUMENTS

| | | | |
|---|---|---|---|
| CN | 202431515 | U | 9/2012 |
| DE | 4338875 | A1 | 5/1995 |
| DE | 20 2012 104 839 | U1 | 3/2013 |
| EP | 1760315 | A2 | 3/2007 |

OTHER PUBLICATIONS

Chinese Patent Publication CN-105673480-A with the machine translation, Inventor: Zhou, (Year: 2016).*
WIPO Publication WO-9512070-A1 with machine translation, Inventor: Eckerle. (Year: 1995).*

* cited by examiner

*Primary Examiner* — Mary Davis
(74) *Attorney, Agent, or Firm* — McDonnell Boehnen Hulbert & Berghoff LLP

(57) ABSTRACT

An example crescent seal assembly comprises: an outer crescent of a gear pump; an inner crescent of the gear pump mating with the outer crescent such that an exterior peripheral surface of the inner crescent interfaces with an interior peripheral surface of the outer crescent, forming: (i) a spring cavity, (ii) a first check valve cavity, and (iii) a second check valve cavity therebetween; a spring disposed in the at least one spring cavity; a first check pin disposed in the first check valve cavity; and a second check pin disposed in the second check valve cavity.

20 Claims, 7 Drawing Sheets

HYDRAULIC GEAR PUMP WITH RADIAL PRESSURE COMPENSATOR

CROSS REFERENCE TO RELATED APPLICATION

The present application claims priority to U.S. Provisional patent application No. 62/982,310 filed on Feb. 27, 2020, and entitled "Hydraulic Gear Pump with a Radial Pressure Compensator," the entire contents of which are herein incorporated by reference as if fully set forth in this description.

BACKGROUND

A gear pump uses the meshing of gears to pump fluid by displacement. There are two main variations: external gear pumps, which use two external spur gears, and internal gear pumps, which use an external (e.g., pinion) and internal (e.g., ring) spur gears. Gear pumps have fixed displacement, where the pump can provide a constant amount of fluid for each revolution.

As the gears of the pump rotate, their teeth separate on the intake side of the pump, creating a void and suction, and the void is then filled by fluid. The fluid is carried by the gears to the discharge or outlet side of the pump, where the meshing of the gears displaces the fluid.

Suction and discharge ports interface where the gears mesh. As such, some pockets or chambers formed between the meshing gear teeth interface with the suction or inlet port having low pressure fluid, while other pockets or chambers formed between the meshing gear teeth interface with the discharge or outlet port with high pressure fluid. It may be desirable to isolate or seal chambers with high pressure or displaced fluid from chambers with low pressure fluid to prevent leakage therebetween, as leakage may reduce efficiency and performance of the pump.

To ensure that the teeth of the two meshing gears effectively prevent fluid from leaking backward, tight mechanical or manufacturing clearances can be used, e.g., in the order of 10 micrometer (μm). Achieving such tolerance levels can be costly. Further, over time, due to wear, leakage may occur despite high manufacturing tolerances.

It may thus be desirable to have a gear pump with a configuration that dynamically adjusts for any clearance between the gears of the pump during operation and variation of pressure to reduce the likelihood of occurrence of any leakage. It is with respect to these and other considerations that the disclosure made herein is presented.

SUMMARY

The present disclosure describes implementations that relate to a hydraulic gear pump with a radial pressure compensator.

In a first example implementation, the present disclosure describes an assembly. The assembly includes: (i) an outer crescent of a gear pump, wherein the outer crescent comprises a first axial groove; (ii) an inner crescent of the gear pump, wherein the inner crescent comprises a second axial groove, wherein the inner crescent mates with the outer crescent such that an exterior peripheral surface of the inner crescent interfaces with an interior peripheral surface of the outer crescent and the first axial groove faces the second axial groove, thereby forming: (a) at least one spring cavity, (b) a first check valve cavity, (c) a second check valve cavity, and (d) a shuttle check valve cavity between the first axial groove and the second axial groove; (iii) a spring disposed in the at least one spring cavity such that the spring pushes the outer crescent and the inner crescent radially apart; (iv) a first check pin disposed in the first check valve cavity and configured to preclude leakage fluid flow between the outer crescent and the inner crescent in a first direction during operation of the gear pump in a first rotational direction; (v) a second check pin disposed in the second check valve cavity and configured to preclude leakage fluid flow between the outer crescent and the inner crescent in a second direction opposite the first direction during operation of the gear pump in a second rotational direction opposite the first rotational direction; and (vi) a shuttle check pin disposed in the shuttle check valve cavity and configured to preclude leakage fluid flow between the outer crescent and the inner crescent in the first direction and the second direction during operation of the gear pump.

In a second example implementation, the present disclosure describes a gear pump. The gear pump includes: a pump ring gear; a pump pinion disposed within the pump ring gear, such that external teeth of the pump pinion are configured to engage with internal teeth of the pump ring gear, wherein a center of rotation of the pump pinion is offset from a center of rotation of the pump ring gear; and a crescent seal assembly disposed within the pump ring gear between the pump pinion and the pump ring gear. The crescent seal assembly includes: (i) an outer crescent having an exterior peripheral surface interfacing with the internal teeth of the pump ring gear; (ii) an inner crescent having an interior peripheral surface interfacing with the external teeth of the pump pinion, wherein the inner crescent mates with the outer crescent such that an exterior peripheral surface of the inner crescent interfaces with an interior peripheral surface of the outer crescent, forming: (a) at least one spring cavity, (b) a first check valve cavity, and (c) a second check valve cavity therebetween, wherein the outer crescent further comprises a first axial groove, wherein the inner crescent further comprises a second axial groove facing the first axial groove, forming a shuttle check valve cavity therebetween; (iii) a spring disposed in the at least one spring cavity such that the spring pushes the outer crescent and the inner crescent radially apart; (iv) a first check pin disposed in the first check valve cavity and configured to preclude leakage fluid flow between the outer crescent and the inner crescent in a first direction when the pump pinion rotates in a first rotational direction; (v) a second check pin disposed in the second check valve cavity and configured to preclude leakage fluid flow between the outer crescent and the inner crescent in a second direction opposite the first direction when the pump pinion rotates in a second rotational direction opposite the first rotational direction; and (vi) a shuttle check pin disposed in the shuttle check valve cavity and configured to preclude leakage fluid flow between the outer crescent and the inner crescent in the first direction and the second direction.

In a third example implementation, the present disclosure describes a method. The method includes: (i) mating an outer crescent of a gear pump with an inner crescent of the gear pump, such that an exterior peripheral surface of the inner crescent interfaces with an interior peripheral surface of the outer crescent, forming: (a) at least one spring cavity, (b) a first check valve cavity, and (c) a second check valve cavity therebetween, wherein the outer crescent further comprises a first recess formed in a distal end face of the outer crescent at a vertex of the outer crescent, wherein the inner crescent further comprises a second recess in a respective distal end face of the inner crescent at a respective vertex of the inner crescent, such that the first recess mates with the second recess to form a depression configured to receive an end of a locating pin of the gear pump therein, wherein the first recess spans less than an entire radial thickness of the outer crescent and the second recess spans less than an entire radial thickness of the inner crescent; (ii) inserting a spring in the at least one spring cavity, such that the spring pushes the outer crescent and the inner crescent radially apart; (iii) inserting a first check pin in the first check valve cavity to preclude leakage fluid flow between the outer crescent and the inner crescent in a first direction during operation of the gear pump in a first rotational direction; and (iv) inserting a second check pin in the second check valve cavity to preclude leakage fluid flow between the outer crescent and the inner crescent in a second direction opposite the first direction during operation of the gear pump in a second rotational direction opposite the first rotational direction.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

The present disclosure relates to using radial pressure compensators configured to maintain contact with teeth of the gears of a gear pump to effectively seal high pressure chambers form low pressure chambers. The radial pressure compensators are further configured to preclude leakage in both directions (from an intake chamber to a discharge chamber, and vice versa), thus enabling the gear pump to be bi-directional. In a bi-directional pump having a first port and a second port, either port can be an inlet port or an outlet port, and the pump can thus drive a hydraulic actuator in two opposite directions. The pump can also operate in a regenerative mode, i.e., can operate as a motor.

Figure 1:
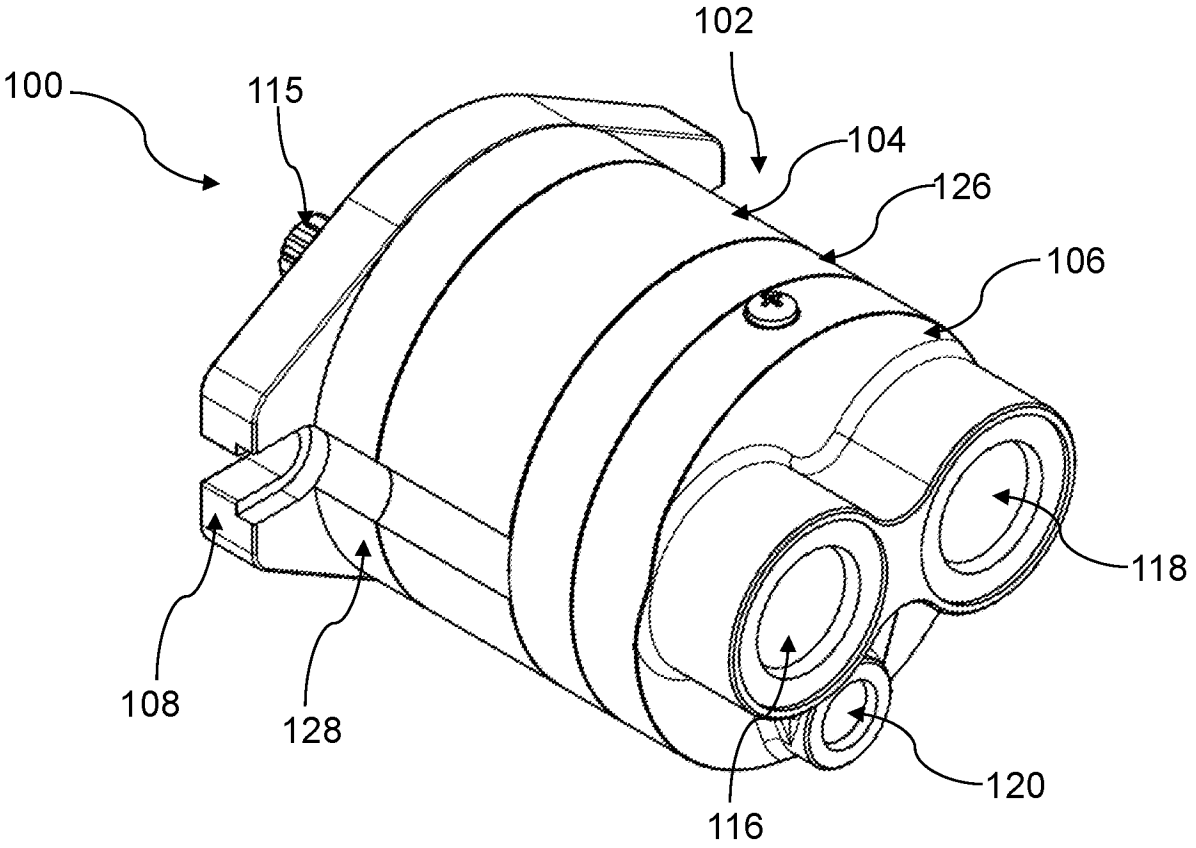
FIG. 1 illustrates a perspective view of an assembly, in accordance with an example implementation.
Figure 2:
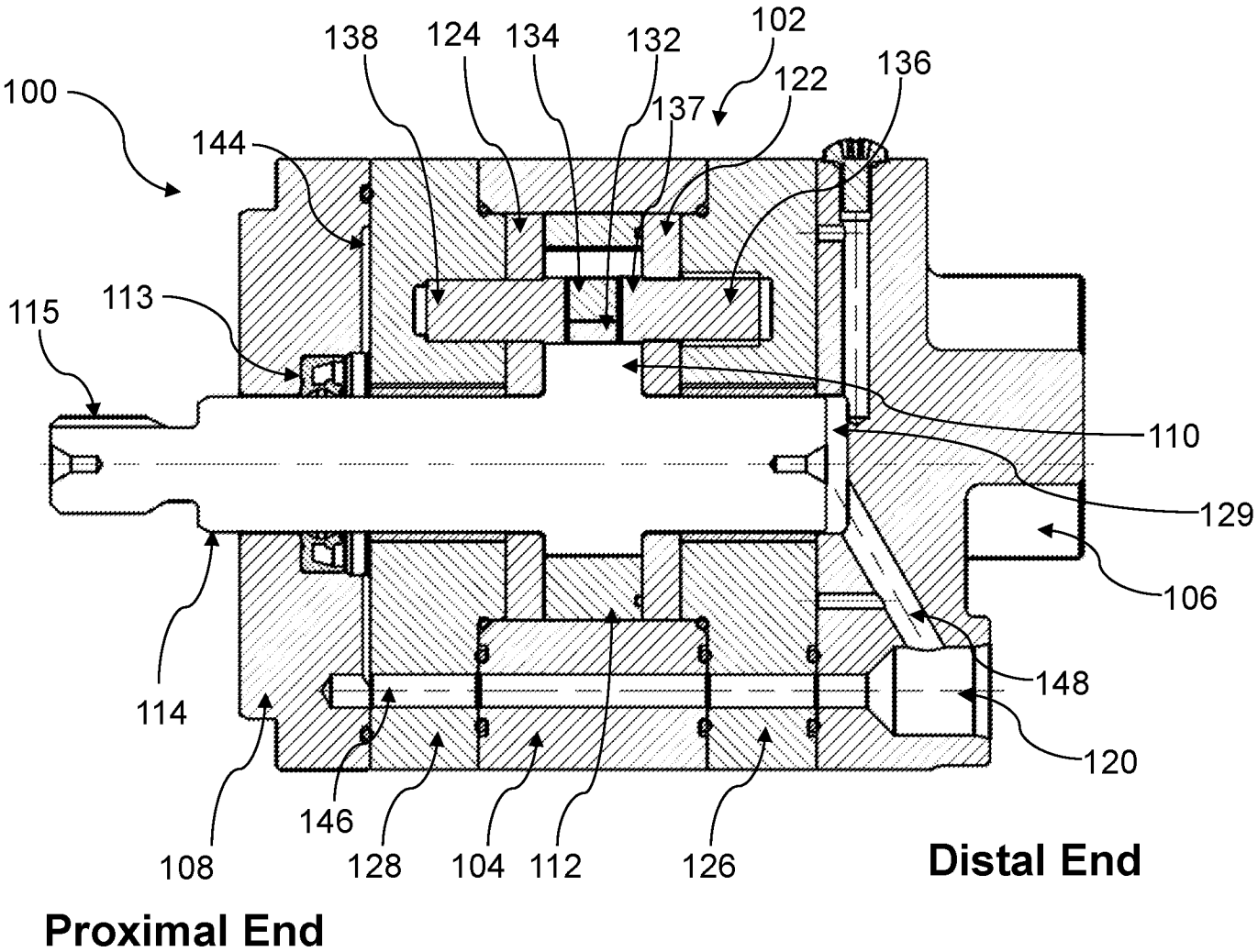
FIG. 2 illustrates a cross-sectional side view of the assembly of FIG. 1, in accordance with an example implementation.
Figure 3:
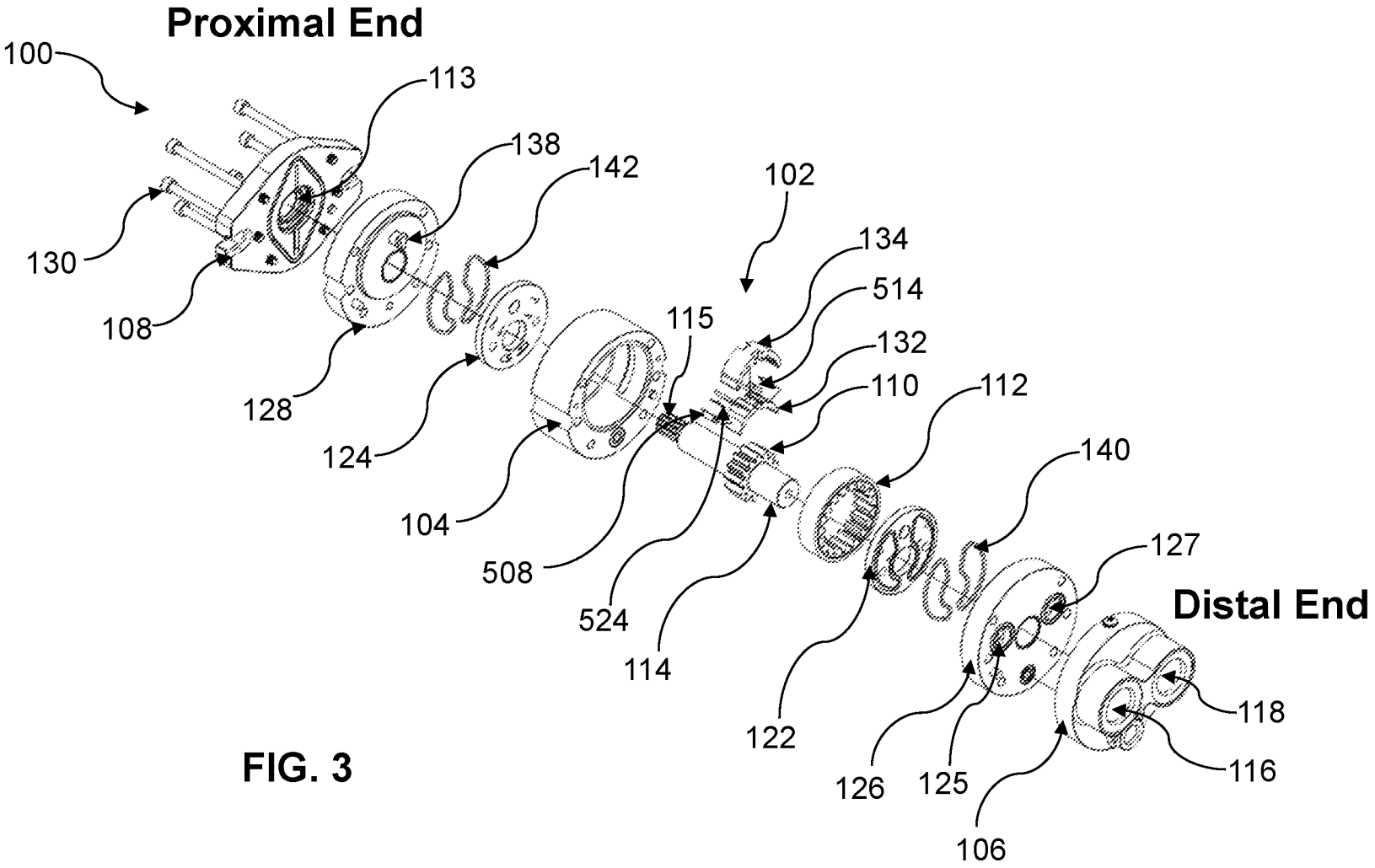
FIG. 3 illustrates a perspective exploded view of the assembly of FIG. 1, in accordance with an example implementation.

FIG. 1 illustrates a perspective view of an assembly 100, FIG. 2 illustrates a cross-sectional side view of the assembly 100, and FIG. 3 illustrates a perspective exploded view of the assembly 100, in accordance with an example implementation. FIGS. 1-3 are described together.

The assembly 100 comprises a gear pump 102 having a pump housing 104 configured to house components of the gear pump 102. The gear pump 102 is mounted or interposed between a first end cover 106 and a second end cover 108 of the assembly 100.

As shown in FIGS. 2-3, the gear pump 102 is configured as an internal gear pump having a pump pinion 110 (e.g., a spur gear having external teeth formed in an exterior peripheral surface thereof) and a pump ring gear 112 (e.g., ring gear having internal teeth formed in an interior peripheral surface thereof) disposed within the pump housing 104. As depicted in FIGS. 2-3, the pump pinion 110 is mounted to, or is an integral portion of, a pump shaft 114, and the teeth of the pump pinion 110 engage with the teeth of the pump ring gear 112. Further, the pump pinion 110 is mounted off-center relative to the pump ring gear 112, i.e., a center of rotation of the pump pinion 110 is eccentric relative to or offset from a center of rotation of the pump ring gear 112.

The pump shaft 114 is supported within the assembly 100 via a bearing 113 disposed within the second end cover 108 to allow the pump shaft 114 to rotate relative to the second end cover 108. In examples, the pump shaft 114 can be rotatably coupled to a gearbox or a rotor of an electric motor via splines 115 to provide rotary motion to the pump pinion 110 and the pump ring gear 112 via the pump shaft 114.

As shown in FIGS. 1, 3, the first end cover 106 can have a first port 116 and a second port 118. The first end cover 106 further has a drain port 120.

The gear pump 102 is configured to operate as a bi-directional pump. Particularly, the first port 116 can operate as an inlet port configured to receive fluid from a fluid reservoir fluidly coupled to the assembly 100 (e.g., via a hose of any hydraulic line), and the second port 118 can operate as an outlet port for providing pressurized fluid being discharged from the gear pump 102 to a hydraulic consumer, e.g., an hydraulic actuator, fluidly coupled to the assembly 100. The hydraulic actuator can, for example, by a hydraulic cylinder having a piston linearly moving therein or can be a hydraulic motor. In this mode of operation, the pump pinion 110 and the pump ring gear 112 rotate in a first rotational direction and the hydraulic actuator can move in a first direction.

In another mode of operation, the first port 116 can operate as an outlet port for providing pressurized fluid being discharged from the gear pump 102 to the hydraulic actuator, and the second port 118 can operate as an inlet port configured to receive fluid from the fluid reservoir. In this mode of operation, the pump pinion 110 and the pump ring gear 112 rotate in a second rotational direction opposite the first rotational direction, and the hydraulic actuator can move in a second direction opposite the first direction.

The pump ring gear 112 and the pump pinion 110 are supported axially within the pump housing 104 via a first thrust plate 122 disposed on a distal side of the pump ring gear 112 and the pump pinion 110 and a second thrust plate 124 on the proximal side of the pump ring gear 112 and the pump pinion 110. As such, the pump pinion 110 and the pump ring gear 112 are interposed or sandwiched between the thrust plates 122, 124. As described below, the thrust plates 122, 124 can operate as axial compensator that can reduce the leakage within the gear pump 102 and improve its efficiency.

The thrust plates 122, 124 are in turn supported by a first pump cover 126 and a second pump cover 128. As shown in FIG. 3, the first pump cover 126 interfaces with the first end cover 106 and have through-hole 125 and through-hole 127 corresponding to and aligned with the first port 116 and the second port 118, respectively, to allow for fluid communication through the first pump cover 126.

Similarly, the second pump cover 128 interfaces with the second end cover 108. The first end cover 106, the first pump cover 126, the second pump cover 128, and the second end cover 108 have fastener through-holes disposed in a circular array, such that a plurality of fasteners or bolts 130 (e.g., socket head bolts) can be used to couple them axially together in a tight axial assembly. As such, the first end cover 106, the first pump cover 126, the second pump cover 128, and the second end cover 108 and components of the gear pump 102 disposed therebetween can be aligned and stacked, then bolted together using the bolts 130.

With this configuration, components of the gear pump 102 are interposed between and supported by pump covers 126, 128, which in turn are supported by the end covers 106, 108. As depicted in FIG. 2, the second end cover 108, the pump covers 126, 128, and the thrust plates 122, 124 include respective central through-holes to accommodate the pump shaft 114 therethrough. The first end cover 106 has a cavity 129 in which the distal end of the pump shaft 114 is disposed.

Figure 4:
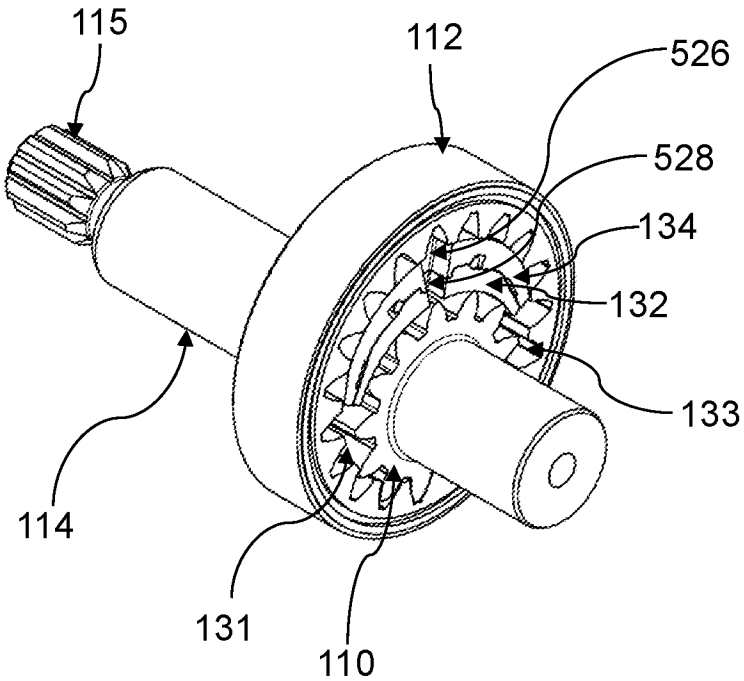
FIG. 4 illustrates a perspective view of a partial assembly of a gear pump, in accordance with an example implementation.

FIG. 4 illustrates a perspective view of a partial assembly of the gear pump 102, in accordance with an example implementation. Particularly, FIG. 4 illustrates the pump shaft 114, the pump pinion 110 coupled thereto or integrated therewith, and the pump ring gear 112. Operating of the gear pump 102 is described next assuming it rotates in a given direction; however, it should be understood that the gear pump 102 can operate in the other direction as well where the operation of the ports and chambers is reversed.

During operation, as the pump shaft 114 rotates, the pump pinion 110 rotates within the pump ring gear 112. As the external gear teeth of the pump pinion 110 and the internal gear teeth of the pump ring gear 112 separate or disengage, they create an expanding volume or chamber 131. The chamber 131 collectively represents multiple pockets formed between the separating teeth. The expanding volume in the chamber 131 operates as a suction void forming between the separating teeth on the intake side of the gear pump 102 that is fluidly coupled to the inlet port (e.g., the first port 116). Fluid from the inlet port thus fills the chamber 131 between the teeth.

The fluid is carried by the gear teeth of the pump pinion 110 and the pump ring gear 112 to a chamber 133 on a discharge side of the gear pump 102, which is fluidly coupled to the outlet port (e.g., the second port 118). The meshing of the gear teeth of the pump pinion 110 and the pump ring gear 112 displaces the fluid, and the fluid is then provided to the outlet port. In other words, as the teeth of the pump pinion 110 and the pump ring gear 112 become interlocked on the discharge side of the gear pump 102, the volume is reduced and the fluid is forced out under pressure.

As the teeth of the pump pinion 110 and the pump ring gear 112 mesh, they form a seal between the pockets between the separating teeth (i.e., the chamber 131 having low pressure fluid received from the inlet port) and pockets between teeth that are about to mesh (i.e., the chamber 133 that is fluidly coupled to the discharge or outlet port). The seal created by the meshed teeth forces the fluid out of the discharge port and prevents fluid from flowing back toward the inlet port.

Further, as shown in FIGS. 2-4, the gear pump 102 includes an inner crescent 132 and an upper or outer crescent 134. The terms "inner" and "outer" indicate radial positioning of the crescents, where the inner crescent 132 is disposed radially inward relative to the outer crescent 134.

The inner crescent 132 and the outer crescent 134 are axially supported within the internal space between the pump ring gear 112 and the pump pinion 110 by a first locating pin 136 and a second locating pin 138 depicted in FIG. 2 (the locating pin 138 is also shown in FIG. 3). As shown in FIG. 2, the locating pin 136 is disposed partially in a cavity formed in the first pump cover 126 and extends through a hole in the thrust plate 122 to axially interface with distal ends of the crescents 132, 134. Similarly, the locating pin 138 is disposed partially in a cavity formed in the second pump cover 128 and extends through a hole in the thrust plate 124 to axially interface with proximal ends of the crescents 132, 134.

With this configuration, the inner crescent 132 and the outer crescent 134 are held axially in position by the locating pins 136, 138, and the locating pins 136, 138 also maintain the orientation of the crescents 132, 134. In other words, the locating pins 136, 138 support the inner crescent 132 and the outer crescent 134 in an axial direction.

As the pump pinion 110 and the pump ring gear 112 rotate during operation of the gear pump 102, the crescents 132, 134 divide the fluid as it is being carried from the chamber 131 (the low pressure suction pockets) to the chamber 133 (the discharge pockets). As described in more detail below, the crescents 132, 134 form a seal between the chamber 131 and the chamber 133, and further operate as radial compensators that eliminate radial clearances between the crescents 132, 134 and the gear teeth to create an effective seal.

Referring to FIGS. 2-4 together, fluid in the chamber 131 and the chamber 133 can be communicated axially in both directions via through-holes in the thrust plates 122, 124, where the through-holes are aligned with the chambers 131, 133. Fluid thus reaches the interfaces between the thrust plates 122, 124 and the pump covers 126, 128, respectively.

Fluid trapped at the interface between the thrust plate 122 and the first pump cover 126 applies an axial fluid force on the thrust plate 122 toward distal end faces of the pump pinion 110 and the pump ring gear 112. This way, a metal-to-metal seal is created between the thrust plate 122 and the distal end faces of the pump pinion 110 and the pump ring gear 112. Similarly, fluid trapped at the interface between the thrust plate 124 and the pump cover 128 applies an axial fluid force on the thrust plate 124 toward proximal end faces of the pump pinion 110 and the pump ring gear 112. This way, a metal-to-metal seal is created between the thrust plate 124 and the proximal end faces of the pump pinion 110 and the pump ring gear 112.

The fluid forces acting on the thrust plates 122, 124 toward the pump pinion 110 and the pump ring gear 112 pushes or squeezes the thrust plates 122, 124 axially against the pump pinion 110 and the pump ring gear 112, thereby creating an effective seal and eliminating any axial gaps therebetween. As such, the thrust plates 122, 124 can be referred to as axial compensators as they can compensate for any axial gaps between the thrust plates 122, 124 and the pump pinion 110 and the pump ring gear 112 disposed therebetween, thereby reducing leakage and improving efficiency of the gear pump 102.

Referring to FIG. 3, the gear pump 102 can include a first set of kidney-shaped seals 140 disposed in contoured cavities or recesses in a distal side of the thrust plate 122, where the recesses have a shape matching the shape of the first set of kidney-shaped seals 140. Thus, the first set of kidney-shaped seals 140 is placed on the distal side of the thrust plate 122 facing the first pump cover 126. With this configuration, the first set of kidney-shaped seals 140 isolate or seal high pressure fluid (from the chamber 133) trapped between the thrust plate 122 and the first pump cover 126 from low pressure fluid (from the chamber 131) trapped between the thrust plate 122 and the first pump cover 126. The first set of kidney-shaped seals 140 thus precludes cross-flow or leakage from the high pressure side (the chamber 133) to the low pressure side (the chamber 131). The term "preclude fluid flow" is used herein to indicate substantially preventing fluid flow except for minimal flow of drops per minute, for example.

Similarly, the gear pump 102 can include a second set of kidney-shaped seals 142 disposed in contoured cavities or recesses in a proximal side of the thrust plate 124, where the recesses have a shape matching the shape of the second set of kidney-shaped seals 142. Thus, the second set of kidney-shaped seals 142 is placed on a proximal side of the thrust plate 124 facing the second pump cover 128. The second set of kidney-shaped seals 142 isolate or seal high pressure fluid (from the chamber 133) trapped between the thrust plate 124 and the second pump cover 128 from low pressure fluid (from the chamber 131) trapped between the thrust plate 124 and the second pump cover 128. The second set of kidney-shaped seals 142 thus precludes cross-flow or leakage from the high pressure side (the chamber 133) to the low pressure side (the chamber 131).

Referring back to FIG. 2, a cavity or recess 144 in the second end cover 108 is fluidly coupled to the drain port 120 through a drain passage 146 to drain any high pressure fluid that reaches the second end cover 108 to reduce internal pressure within the gear pump 102. Similarly, the cavity 129 in the first end cover 106 is fluidly coupled to the drain port 120 through a drain passage 148 to drain any high pressure fluid that reaches the first end cover 106 to reduce internal pressure within the gear pump 102.

Referring to FIG. 4, as mentioned above, the crescents 132, 134 form a seal between the chamber 131 and the chamber 133 as the pump pinion 110 and the pump ring gear 112 rotate. Particularly, the outer surface (i.e., radially outward surface) of the outer crescent 134 interfaces with the inner teeth of the pump ring gear 112 to create a seal therebetween. An effective seal between the outer surface of the outer crescent 134 and the inner teeth of the pump ring gear 112 may preclude leakage from the chamber 133 to the chamber 131.

In a similar manner, the inner surface (i.e., radially inward surface) of the inner crescent 132 interfaces with the external teeth of the pump pinion 110 to create a seal therebetween. An effective seal between the inner surface of the inner crescent 132 and the external teeth of the pump pinion 110 may preclude leakage from the chamber 133 to the chamber 131.

The configuration of an assembly of the crescents 132, 134 disclosed herein provides for an effective seal and compensates for radial clearances between the crescents 132, 134 and the gear teeth to create an effective seal.

Figure 5:
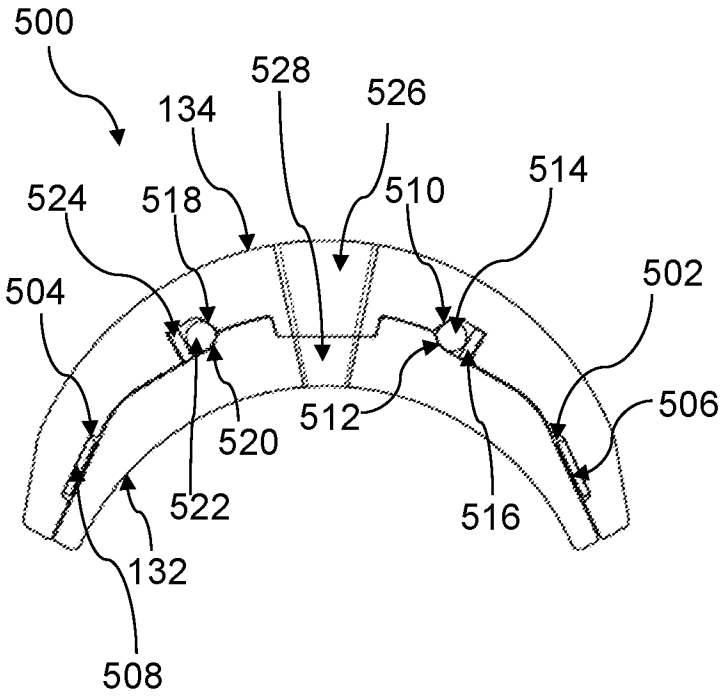
FIG. 5 illustrates a front view of an assembly of an inner crescent and an outer crescent, in accordance with an example implementation.

FIG. 5 illustrates a front view of an assembly 500 of the inner crescent 132 and the outer crescent 134, in accordance with an example implementation. The assembly 500 of the outer crescent 134 with the inner crescent 132 can be referred to as a crescent seal or a crescent seal assembly.

Referring to FIGS. 4 and 5 together, fluid from the chamber 131 and the chamber 133 can seep through the interface between the inner surface of the outer crescent 134 and the outer surface of the inner crescent 132.

Fluid from either the chamber 131 or the chamber 133 seeping through the interface between the outer crescent 134 and the inner crescent 132 can push the crescents 132, 134 radially apart. Particularly, the fluid between the crescents 132, 134 can push the outer crescent 134 radially outward toward the inner teeth of the pump ring gear 112, thereby eliminating any radial space or clearance therebetween and forming an effective seal. Similarly, the fluid between the crescents 132, 134 can push the inner crescent 132 radially inward toward the external teeth of the pump pinion 110, thereby eliminating any radial space or clearance therebetween and forming an effective seal.

Further, the crescents 132, 134 are configured such that a first spring cavity 502 and a second spring cavity 504 are formed therebetween. Although two spring cavities 502, 504 are illustrated, in other example implementations at least one spring cavity can be used.

In the example implementation in FIG. 5, the spring cavities 502, 504 are formed as recesses in the inner surface of the outer crescent 134. In other example implementations, the spring cavities 502, 504 can be formed as recesses in the outer surface of the inner crescent 132. In another example, both the inner crescent 132 and the outer crescent 134 can have mating or facing recesses that form the spring cavities therebetween.

The spring cavity 502 can receive first leaf spring 506 therein. Similarly, the spring cavity 504 can receive a second leaf spring 508 therein. In addition to fluid pushing the crescents 132, 134 radially apart, the leaf springs 506, 508 disposed in the spring cavities 502 also push the crescents 132, 134 radially apart.

With this configuration, the leaf springs 506, 508 push the outer crescent 134 radially outward toward the inner teeth of the pump ring gear 112, thereby enhancing effectiveness of the seal therebetween. Similarly, the leaf springs 506, 508 push the inner crescent 132 radially inward toward the external teeth of the pump pinion 110, thereby enhancing effectiveness of the seal therebetween. Leaf springs are used herein as example biasing elements. Other types of springs can be used, such as wave springs or coil springs.

Further, the assembly 500 includes check valves between the crescents 132, 134 to preclude fluid flow from the chamber 133 to the chamber 131 when the gear pump 102 is operating in one direction, and from the chamber 131 to the chamber 133 when the gear pump 102 is operating in the other direction. In particular, the outer crescent 134 can have inner sloped surface 510, and the inner crescent 132 can have a corresponding outer sloped surface 512, thereby forming a first check valve cavity or recess therebetween. The first check valve cavity is formed as an axial groove along an axial length of the crescents 132, 134. A check pin 514 can thus be positioned in the first check valve cavity between the inner sloped surface 510 and the outer sloped surface 512.

Assuming that pressurized fluid is seeping between the crescents 132, 134 from the chamber 133 through the spring cavity 502 toward the check pin 514, the pressurized fluid pushes the check pin 514 against the sloped surfaces 510, 512, which form a seat for the check pin 514. The check pin 514 thus creates a seal with the sloped surfaces 510, 512 and precludes leakage thereacross to the other side of the assembly 500 toward the chamber 131.

Further, in an example, the assembly 500 can include a check spring 516 disposed in the first check valve cavity in which the check pin 514 is disposed. The check spring 516 can push the check pin 514 toward the sloped surfaces 510, 512, further enhancing effectiveness of the check pin 514 in blocking fluid leakage thereacross. The term "block fluid" is used herein to indicate substantially preventing fluid flow except for minimal flow of drops per minute, for example.

Similarly, the outer crescent 134 can have inner sloped surface 518 and the inner crescent 132 can have a corresponding outer sloped surface 520, thereby forming a second check valve cavity or recess therebetween. The second check valve cavity is also formed as an axial groove along an axial length of the crescents 132, 134. A check pin 522 can thus be positioned in the second check valve cavity between the inner sloped surface 518 and the outer sloped surface 520.

Assuming that pressurized fluid is seeping between the crescents 132, 134 from the chamber 131 through the spring cavity 504 toward the check pin 522, the pressurized fluid pushes the check pin 522 against the sloped surfaces 518, 520, which form a respective seat for the check pin 522. The check pin 522 thus creates a seal with the sloped surfaces 518, 520 and precludes leakage thereacross to the other side of the assembly 500 toward the chamber 133.

Further, in an example, the assembly 500 can include a check spring 524 disposed in the second check valve cavity in which the check pin 522 is disposed. The check spring 524 can push the check pin 522 toward the sloped surfaces 518, 520, further enhancing effectiveness of the check pin 522 in blocking fluid leakage thereacross.

This configuration of the assembly 500 enables the gear pump 102 to be bi-directional. Whether fluid is drawn through the first port 116 to the chamber 131, then displaced to the chamber 133 and discharged from the second port 118, or vice versa (i.e., fluid is drawn through the second port 118 to the chamber 133, then displaced to the chamber 131 and discharged from the first port 116), the check pins 514, 522 operate as opposite check valves that prevent leakage fluid flow in either direction. Additional check pins can be added to further enhance the seal between the intake side and the discharge side of the gear pump 102.

Figure 6:
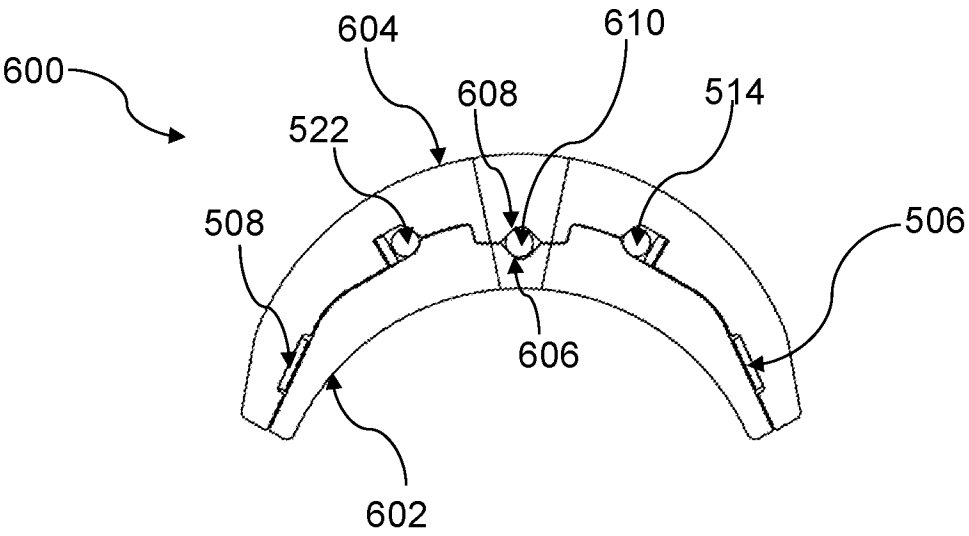
FIG. 6 illustrates a front view of an assembly of an inner crescent and an outer crescent, in accordance with an example implementation.

FIG. 6 illustrates a front view of an assembly 600 of an inner crescent 602 and an outer crescent 604, in accordance with an example implementation. The assembly 600 of the outer crescent 604 with the inner crescent 602 can also be referred to as a crescent seal or a crescent seal assembly. The inner crescent 602 and the outer crescent 604 are generally similar to the inner crescent 132 and the outer crescent 134, respectively and also have leaf springs 506, 508 and check pins 514, 522 disposed therebetween.

Additionally, the inner crescent 602 can have two sloped surfaces forming a groove 606 that is V-shaped. Similarly, the outer crescent 604 can have two sloped surface forming a groove 608 that is also V-shaped and facing the groove 606 of the inner crescent.

With this configuration, the groove 606 and the groove 608 form therebetween a shuttle check valve cavity having a diamond shape. The assembly 600 further comprises a shuttle check pin 610 disposed in the shuttle check valve cavity formed between the grooves 606, 608.

The shuttle check pin 610 operates in a manner similar to the check pins 514, 522 but is configured to blocked fluid flow in both directions. If any leakage fluid flow leaks around the check pin 514 (when the gear pump 102 operates in one direction), the fluid pushes the shuttle check pin 610 against the opposite sloped surfaces of the grooves 606, 608, and the shuttle check pin 610 blocks the leakage flow.

If on the other hand, any leakage fluid flow leaks around the check pin 522 (when the gear pump 102 operates in the opposite direction), the fluid pushes the shuttle check pin 610 against the opposite sloped surfaces of the grooves 606, 608, and the shuttle check pin 610 blocks the leakage flow. As such, the shuttle check pin 610 can operate as a backup to the check pins 514, 522, and reduces the likelihood of leakage occurring within the gear pump 102 from the discharge side to the inlet side.

Referring back to FIGS. 4-5, the outer crescent 134 can have a recess 526 formed in a distal end face of the outer crescent 134 at a vertex of the outer crescent 134. The recess 526 has a generally trapezoidal cross section and spans an entire radial length of the outer crescent 134 (i.e., the entire radial thickness of the outer crescent 134) as depicted in FIGS. 4-5. Similarly, the inner crescent 132 can have a recess 528 in a respective distal end face of the inner crescent 132 at a respective vertex of the inner crescent 132. The recess 528 also has a generally trapezoidal cross section spans an entire radial length of the inner crescent 132 (i.e., the entire radial thickness of the inner crescent 132) as depicted in FIGS. 4-5.

Together, the recess 526 and the recess 528 form a depression that having a generally trapezoidal cross-sectional shape with curved bases. As such, a lower or inner base of the depression is a curved portion of the inner peripheral surface of the inner crescent 132, whereas an upper or outer base of the depression is a curved portion of the outer peripheral surface of the outer crescent 134.

With this configuration, the depression formed by the recesses 526, 528 extends from the inner peripheral surface of the inner crescent 132 that mates with the teeth of the pump pinion 110 to the outer peripheral surface of the outer crescent 134 that mates with the teeth of the pump ring gear 112. The proximal end faces of the crescents 132, 134, not visible in FIGS. 4-5, also have a similar configuration with a similar depression (see FIG. 3).

The locating pins 136, 138 described above with respect to FIGS. 2-3 can have generally cylindrical bodies with ends having a shape that matches the trapezoidal shape of the depression formed by the recesses 526, 528 (see, e.g., the distal end of the locating pin 138 in FIG. 3). For example, the locating pin 136 can have an end 137 that is received within the recesses 526, 528 (see FIG. 2) to interface with the crescents 132, 134 and support them axially. As such, the end 137 of the locating pin 136 has a shape that can be received within the recesses 526, 528.

With this configuration, the outer surface of the end 137 of the locating pin 136 interfaces with the inner teeth of the pump ring gear 112, whereas the inner surface of the end 137 of the locating pin 136 interfaces with the external teeth of the pump pinion 110. Thus, at the recesses 526, 528, not the entire axial length of the crescents 132, 134 seals against the teeth of the pump pinion 110 and the pump ring gear 112. Rather, the end 137 of the locating pin 136 seals against the teeth at the recesses 526, 528. The locating pin 138 can have a similar configuration. It may be desirable in other example implementation to maintain contact between the crescents 132, 134 and the teeth throughout the axial length of the crescents 132, 134.

Figure 8:
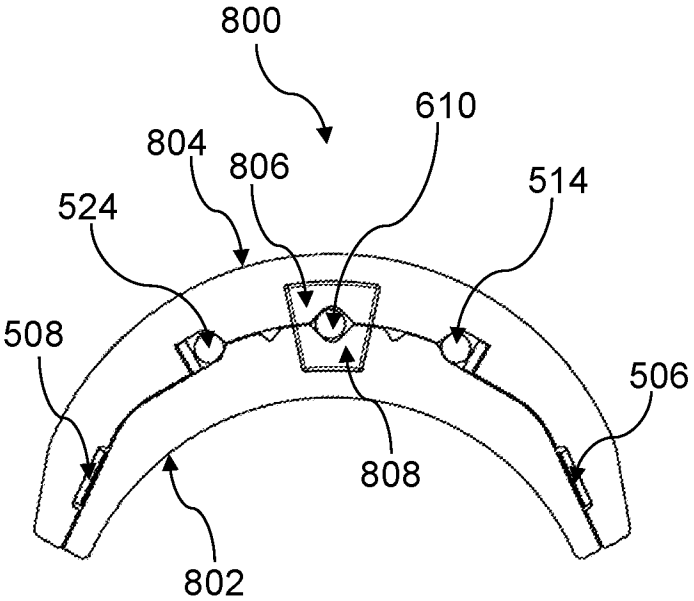
FIG. 8 illustrates a front view of an assembly of an inner crescent and an outer crescent, in accordance with an example implementation.
Figure 7:
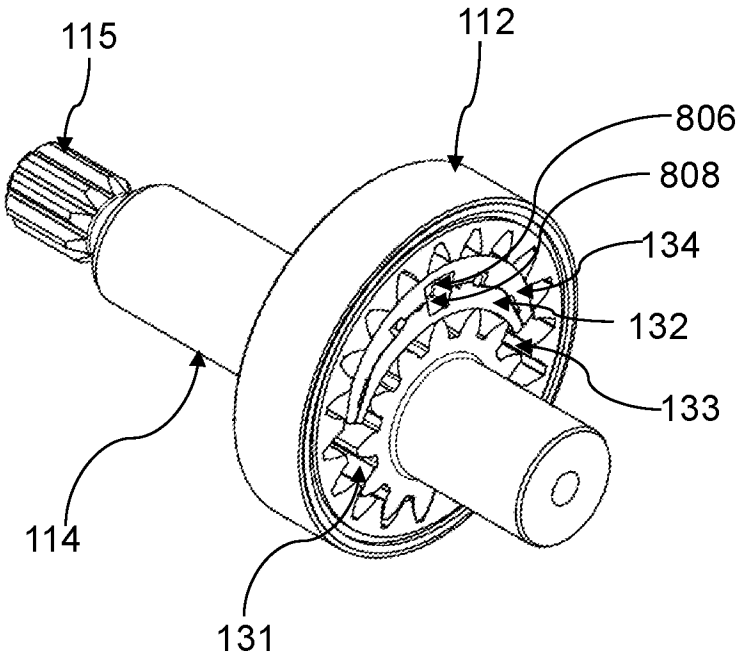
FIG. 7 illustrates a perspective view of a partial assembly of a gear pump with an alternative crescent configuration, in accordance with an example implementation.

FIG. 7 illustrates a perspective view of a partial assembly of the gear pump 102 with an alternative crescent configuration, and FIG. 8 illustrates a front view of an assembly 800 of an inner crescent 802 and an outer crescent 804, in accordance with an example implementation. The assembly 800 of the outer crescent 804 with the inner crescent 802 can also be referred to as a crescent seal or a crescent seal assembly.

The crescents 802, 804 are similar to the crescents 602, 604. However, the outer crescent 804 has a recess 806 that does not extend all the way to the outer peripheral surface of the crescent 804 (i.e., the recess 806 spans less than the entire radial length or radial thickness of the outer crescent 134). Similarly, the inner crescent 802 has a recess 808 that does not extend all the way to the inner peripheral surface of the crescent 802 (i.e., the recess 808 spans less than the entire radial length or radial thickness of the inner crescent 132).

As such, the depression that is formed by the recesses 806, 808 does not extend from the inner peripheral surface of the inner crescent 802 that mates with the teeth of the pump pinion 110 to the outer peripheral surface of the outer crescent 804 that mates with the teeth of the pump ring gear 112. Rather, the outer crescent 804 maintains contact with the teeth of the pump ring gear 112 throughout the entire circumference and axial length of the outer crescent 804, and the inner crescent 802 maintains contact with the teeth of the pump pinion 110 throughout the entire circumference and axial length of the inner crescent 802.

This way, when the fluid between the crescents 802, 804 and the leaf springs 508, 508 pushes the crescents 802, 804 radially apart, an effective seal is maintained between the crescents 802, 804 and the teeth of the pump ring gear 112 and the pump pinion 110 throughout the entire axial length of the crescents 802, 804.

Figure 9:
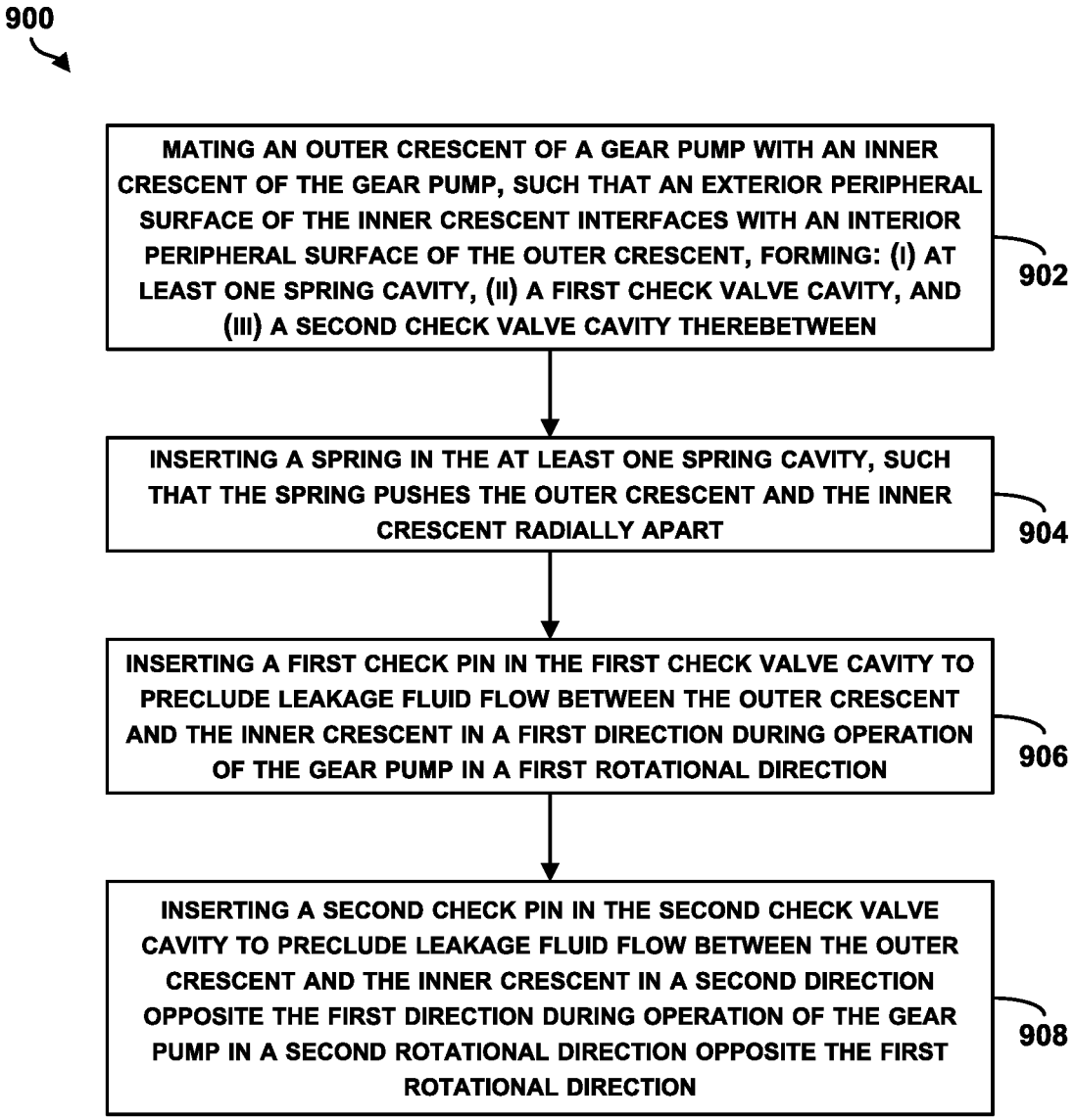
FIG. 9 is a flowchart of a method for assembling crescents of a gear pump, in accordance with an example implementation.

FIG. 9 is a flowchart of a method 900 for assembling crescents of the gear pump 102, in accordance with an example implementation. The method 900 can be used with any of the crescents configurations described above, i.e., the crescents 132, 134, the crescents 602, 604, or the crescents 802, 804.

The method 900 may include one or more operations, functions, or actions as illustrated by one or more of blocks 902-908. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 902, the method 900 includes mating an outer crescent of a gear pump with an inner crescent of the gear pump, such that an exterior peripheral surface of the inner crescent interfaces with an interior peripheral surface of the outer crescent, forming: (i) at least one spring cavity, (ii) a first check valve cavity, and (iii) a second check valve cavity therebetween.

At block 904, the method 900 includes inserting a spring in the at least one spring cavity, such that the spring pushes the outer crescent and the inner crescent radially apart.

At block 906, the method 900 includes inserting a first check pin in the first check valve cavity to preclude leakage fluid flow between the outer crescent and the inner crescent in a first direction during operation of the gear pump in a first rotational direction.

At block 908, the method 900 includes inserting a second check pin in the second check valve cavity to preclude leakage fluid flow between the outer crescent and the inner crescent in a second direction opposite the first direction during operation of the gear pump in a second rotational direction opposite the first rotational direction.

The method 900 can further include other steps described herein such as placing the check springs (e.g., the check springs 516, 524) with their respective check valve cavities to bias their respective check pins toward their seat; placing or inserting the shuttle check pin 610 between the grooves 606, 608, etc.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. An assembly comprising:

an outer crescent of a gear pump;

an inner crescent of the gear pump, wherein the inner crescent mates with the outer crescent such that an exterior peripheral surface of the inner crescent interfaces with an interior peripheral surface of the outer crescent, thereby forming: (i) at least one spring cavity, (ii) a first check valve cavity, and (iii) a second check valve cavity, wherein the outer crescent comprises a first axial groove, and wherein the inner crescent further comprises a second axial groove facing the first axial groove, forming a shuttle check valve cavity therebetween;

a spring disposed in the at least one spring cavity such that the spring pushes the outer crescent and the inner crescent radially apart;

a first check pin disposed in the first check valve cavity and configured to preclude leakage fluid flow between the outer crescent and the inner crescent in a first direction during operation of the gear pump in a first rotational direction;

a second check pin disposed in the second check valve cavity and configured to preclude leakage fluid flow between the outer crescent and the inner crescent in a second direction opposite the first direction during operation of the gear pump in a second rotational direction opposite the first rotational direction; and a shuttle check pin disposed in the shuttle check valve cavity and configured to preclude leakage fluid flow between the outer crescent and the inner crescent in the first direction and the second direction during operation of the gear pump.

2. The assembly of claim 1, wherein the spring is a first spring, and wherein the at least one spring cavity comprises:

a first spring cavity in which the first spring is disposed; and a second spring cavity, wherein the assembly further comprises a second spring disposed in the second spring cavity.

3. The assembly of claim 2, wherein the first spring and the second spring are leaf springs.

4. The assembly of claim 1, further comprising:

a check spring disposed in the first check valve cavity, wherein the check spring biases the first check pin against a seat formed by the interior peripheral surface of the outer crescent and the exterior peripheral surface of the inner crescent.

5. The assembly of claim 4, wherein the check spring is a first check spring, and wherein the assembly further comprises:

a second check spring disposed in the second check valve cavity, wherein the second check spring biases the second check pin against a respective seat formed by the interior peripheral surface of the outer crescent and the exterior peripheral surface of the inner crescent.

6. The assembly of claim 1, wherein the outer crescent further comprises a first recess formed in a distal end face of the outer crescent at a vertex of the outer crescent, wherein the inner crescent further comprises a second recess in a respective distal end face of the inner crescent at a respective vertex of the inner crescent, such that the first recess mates with the second recess to form a depression configured to receive an end of a locating pin of the gear pump therein.

7. The assembly of claim 6, wherein the first recess spans an entire radial thickness of the outer crescent and the second recess spans an entire radial thickness of the inner crescent.

8. The assembly of claim 6, wherein the first recess spans less than an entire radial thickness of the outer crescent and the second recess spans less than an entire radial thickness of the inner crescent.

9. A gear pump comprising:

a pump ring gear;

a pump pinion disposed within the pump ring gear, such that external teeth of the pump pinion are configured to engage with internal teeth of the pump ring gear, wherein a center of rotation of the pump pinion is offset from a center of rotation of the pump ring gear; and a crescent seal assembly disposed within the pump ring gear between the pump pinion and the pump ring gear, wherein the crescent seal assembly comprises:

an outer crescent having an exterior peripheral surface interfacing with the internal teeth of the pump ring gear, an inner crescent having an interior peripheral surface interfacing with the external teeth of the pump pinion, wherein the inner crescent mates with the outer crescent such that an exterior peripheral surface of the inner crescent interfaces with an interior peripheral surface of the outer crescent, forming: (i) at least one spring cavity, (ii) a first check valve cavity, and (iii) a second check valve cavity therebetween, wherein the outer crescent further comprises a first axial groove, wherein the inner crescent further comprises a second axial groove facing the first axial groove, forming a shuttle check valve cavity therebetween, a spring disposed in the at least one spring cavity such that the spring pushes the outer crescent and the inner crescent radially apart, a first check pin disposed in the first check valve cavity and configured to preclude leakage fluid flow between the outer crescent and the inner crescent in a first direction when the pump pinion rotates in a first rotational direction, a second check pin disposed in the second check valve cavity and configured to preclude leakage fluid flow between the outer crescent and the inner crescent in a second direction opposite the first direction when the pump pinion rotates in a second rotational direction opposite the first rotational direction, and a shuttle check pin disposed in the shuttle check valve cavity and configured to preclude leakage fluid flow between the outer crescent and the inner crescent in the first direction and the second direction.

10. The gear pump of claim 9, wherein the spring is a first spring, and wherein the at least one spring cavity comprises:

a first spring cavity in which the first spring is disposed; and a second spring cavity, wherein the crescent seal assembly further comprises a second spring disposed in the second spring cavity.

11. The gear pump of claim 10, wherein the first spring and the second spring are leaf springs.

12. The gear pump of claim 9, wherein the crescent seal assembly further comprises:

a check spring disposed in the first check valve cavity, wherein the check spring biases the first check pin against a seat formed by the interior peripheral surface of the outer crescent and the exterior peripheral surface of the inner crescent.

13. The gear pump of claim 12, wherein the check spring is a first check spring, and wherein the crescent seal assembly further comprises:

a second check spring disposed in the second check valve cavity, wherein the second check spring biases the second check pin against a respective seat formed by the interior peripheral surface of the outer crescent and the exterior peripheral surface of the inner crescent.

14. The gear pump of claim 9, wherein the outer crescent further comprises a first recess formed in a distal end face of the outer crescent at a vertex of the outer crescent, wherein the inner crescent further comprises a second recess in a respective distal end face of the inner crescent at a respective vertex of the inner crescent, such that the first recess mates with the second recess to form a depression, and wherein the gear pump further comprises:

a locating pin having an end received within the depression, thereby supporting the crescent seal assembly in an axial direction.

15. The gear pump of claim 14, wherein the first recess spans an entire radial thickness of the outer crescent and the second recess spans an entire radial thickness of the inner crescent.

16. The gear pump of claim 14, wherein the first recess spans less than an entire radial thickness of the outer crescent and the second recess spans less than an entire radial thickness of the inner crescent.

17. A method comprising:

mating an outer crescent of a gear pump with an inner crescent of the gear pump, such that an exterior peripheral surface of the inner crescent interfaces with an interior peripheral surface of the outer crescent, forming: (i) at least one spring cavity, (ii) a first check valve cavity, and (iii) a second check valve cavity therebetween, wherein the outer crescent further comprises a first recess formed in a distal end face of the outer crescent at a vertex of the outer crescent, wherein the inner crescent further comprises a second recess in a respective distal end face of the inner crescent at a respective vertex of the inner crescent, such that the first recess mates with the second recess to form a depression configured to receive an end of a locating pin of the gear pump therein, wherein the first recess spans less than an entire radial thickness of the outer crescent and the second recess spans less than an entire radial thickness of the inner crescent;

inserting a spring in the at least one spring cavity, such that the spring pushes the outer crescent and the inner crescent radially apart;

inserting a first check pin in the first check valve cavity to preclude leakage fluid flow between the outer crescent and the inner crescent in a first direction during operation of the gear pump in a first rotational direction; and inserting a second check pin in the second check valve cavity to preclude leakage fluid flow between the outer crescent and the inner crescent in a second direction opposite the first direction during operation of the gear pump in a second rotational direction opposite the first rotational direction.

18. The method of claim 17, wherein the spring is a first spring, wherein the at least one spring cavity comprises: a first spring cavity in which the first spring is disposed and a second spring cavity, wherein the method further comprises:

inserting a second spring in the second spring cavity, such that the second spring pushes the outer crescent and the inner crescent radially apart.

19. The method of claim 17, further comprising:

placing a first check spring in the first check valve cavity, thereby biasing the first check pin against a seat formed by the interior peripheral surface of the outer crescent and the exterior peripheral surface of the inner crescent; and placing a second check spring in the second check valve cavity, thereby biasing the second check pin against a respective seat formed by the interior peripheral surface of the outer crescent and the exterior peripheral surface of the inner crescent.

20. The method of claim 17, wherein the outer crescent further comprises a first axial groove, wherein the inner crescent further comprises a second axial groove facing the first axial groove so as to form a shuttle check valve cavity therebetween, and wherein the method further comprises:

inserting a shuttle check pin in the shuttle check valve cavity, wherein the shuttle check pin is configured to preclude leakage fluid flow between the outer crescent and the inner crescent in the first direction and the second direction during operation of the gear pump.

* * * * *